US007543350B2

(12) United States Patent
Cheney et al.

(10) Patent No.: US 7,543,350 B2
(45) Date of Patent: Jun. 9, 2009

(54) APPARATUS FOR APPLYING DRYWALL COMPOUND TO A SURFACE

(76) Inventors: Arthello C. Cheney, 1566 S. 2000 E., Spanish Fork, UT (US) 84660; Bonnie G. Cheney, 1566 S. 2000 E., Spanish Fork, UT (US) 84660

( * ) Notice: Subject to any disclaimer, the term of this patent is extended or adjusted under 35 U.S.C. 154(b) by 551 days.

(21) Appl. No.: 10/915,787

(22) Filed: Aug. 11, 2004

(65) Prior Publication Data

US 2006/0032009 A1 Feb. 16, 2006

(51) Int. Cl.
*B05C 17/10* (2006.01)

(52) U.S. Cl. ..... 15/235.4; 15/245.1; 15/210.1; 15/244.1

(58) Field of Classification Search ..... 15/235.4, 15/245.1, 235.5, 244.1, 236.01, 209.1, 244.4, 15/210.1, 228; D8/45; 425/458
See application file for complete search history.

(56) References Cited

U.S. PATENT DOCUMENTS 2,214,219 A * 9/1940 Barrett ..... 52/749.13
3,038,188 A * 6/1962 Rebernak ..... 15/119.2
3,686,703 A * 8/1972 Ray ..... 15/235.4
4,316,302 A * 2/1982 Clark ..... 15/235.4
4,970,750 A * 11/1990 Davis, III ..... 15/244.1
5,058,233 A * 10/1991 Davis, III ..... 15/244.1
5,075,916 A * 12/1991 Englehart ..... 15/245.1
5,771,525 A * 6/1998 Fulcher et al. ..... 15/244.1
6,014,788 A * 1/2000 Jaffri ..... 15/104.002
D423,743 S * 4/2000 Dawson et al. ..... D32/40
6,044,516 A * 4/2000 Lev ..... 15/235.4
6,088,871 A * 7/2000 Kobayashi ..... 15/220.1
6,170,114 B1 * 1/2001 Woodnorth et al. ..... 15/210.1
6,568,024 B2 * 5/2003 Kent et al. ..... 15/322

* cited by examiner

*Primary Examiner*—Laura C Guidotti
(74) *Attorney, Agent, or Firm*—Steven McDaniel; Utah Valley Patent

(57) ABSTRACT

A lightweight tool for applying compound to drywall and like surfaces is achieved by using closed-cell foam to form an application layer secured to a stiff plate. A handle secures to the stiff plate to facilitate use. An application layer made of closed cell foam of substantially uniform thickness nonetheless provides a lower surface having contoured perimeter portions by conforming to a plate having upwardly sloping perimeter regions. In an alternative embodiment, perimeter portions of an upper surface of an application layer are formed to be downward sloping. The upper surface of the application layer may be secured to the lower surface of a plate. The downward sloping portions may be deformed upwardly to be flush with the plate, creating corresponding upwardly sloping portions on the lower surface of the application layer. In yet another embodiment, the application layer is formed or machined to have an upwardly sloping perimeter portion.

7 Claims, 6 Drawing Sheets

APPARATUS FOR APPLYING DRYWALL COMPOUND TO A SURFACE

BACKGROUND OF THE INVENTION

1. Field of the Invention

The invention relates generally to devices, methods, and systems for applying compounds on building surfaces. Specifically, the invention relates to devices for applying texturing compound, and like substances, to ceilings and interior walls.

2. Description of the Related Art

In a typical building, drywall is applied to walls and ceilings to hide studs and wiring. Paint, wallpaper, and other surface treatments may be used to increase the aesthetic appeal of the dry wall. One particularly pleasing treatment is a textured application of a drywall compound, such as drywall mud. In typical applications, drywall mud is placed on a handheld tool, such as a board, trowel, hawk, or other similar device. The user then places the surface of the tool holding the drywall mud against a surface such as a wall or ceiling. Removing the tool creates raised peaks that may be partially leveled the peaks to create a textured or patterned surface.

Currently available tools for applying compounds such as drywall mud to surfaces such as walls and ceilings, however, include a number of disadvantages. First of all, boards, trowels, hawks, and other tools, are typically intended for other uses and are not adequately designed to apply drywall mud to large surfaces. Often, the drywall mud negatively affects tools made of wood or metal. For example, wood tends to be porous and absorb the drywall mud, making cleaning difficult, and metal tools rust when exposed to the water contained in drywall mud. In addition, metal and wood tools tend to be heavy and difficult to maneuver. In typical applications, a user is required to apply drywall mud in hard to reach areas. Consequently, maintaining a heavy tool in an elevated or awkward position inevitably leads to strain on the back, arms, and shoulders. Moreover, maintaining a heavy tool in the correct orientation can also be difficult. Accordingly, a heavy tool made of metal or wood is undesirable for applying drywall mud to a surface.

Currently available tools also create undesirable edge marks in finished textured surfaces. The sharp, square, edges of prior art tools tend to create distinct marks in the drywall mud where the edge of the tool was positioned during application. These tools also typically have a hard, flat applying surface. Such a surface tends to unevenly apply drywall mud where a user does not press the tool against a surface in a substantially flat orientation. Using currently available tools, one must develop a certain level of skill in order to evenly apply compound without avoid edge marks. Weekend home improvement enthusiasts find it discouraging to attempt to apply texturing to interior surfaces, because they typically lack the skill needed to create an aesthetically pleasing result.

Accordingly, what is needed is a tool for applying drywall compounds to surfaces that is lightweight and resistant to damage from the compound. It would also be an advancement in the art to provide a tool that allows ready and consistent application of compounds without defects such as edge marks from the tool. Such a tool should also be easily maintained and manufactured.

SUMMARY OF THE INVENTION

The various elements of the present invention have been developed in response to the present state of the art, and in particular, in response to the problems and needs in the art that have not yet been fully solved by currently available tools.

In one aspect of the present invention, a drywall applicator for applying drywall compound to a surface is disclosed. The applicator may include a plate having an upper surface and a bottom surface. An application layer secures to the plate and receives a drywall compound during use. The bottom surface of the application layer may have a flat central portion and an upwardly sloping perimeter portion. The upwardly sloping portion of the application layer may form a substantial portion of the lower surface thereof.

In some embodiments, the application layer is made of a compressible material having substantially uniform thickness. The plate may have an upwardly sloping portion formed thereon corresponding to the upwardly sloping portion of the application layer. The application layer may conform to the upwardly sloping portion to form the upwardly sloping perimeter portion thereof. In some embodiments, the upwardly sloping portion of the plate is formed as bevels formed along its edges.

The various elements and aspects of the present invention facilitate the application of drywall mud in a consistent manner without undue strain on the user. These and other features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1A:
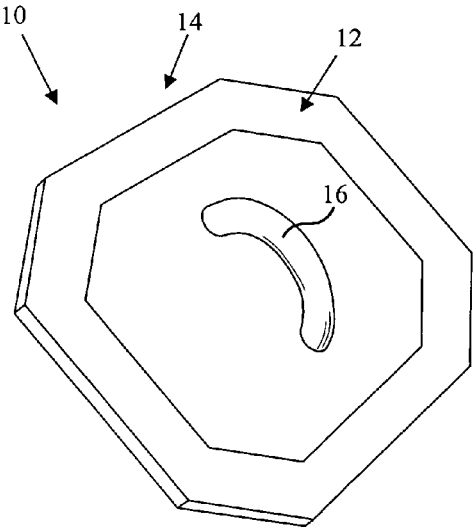
FIG. 1A is an upper perspective view of an applying tool, in accordance with the invention.
Figure 1B:
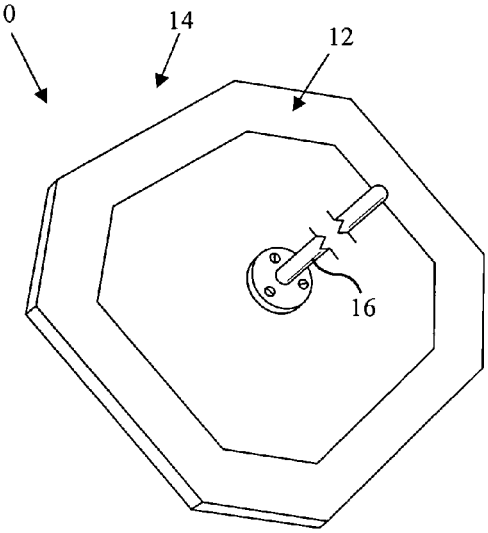
FIG. 1B is an upper perspective view of an alternative embodiment of an applying tool, in accordance with the invention.

Referring to FIG. 1A, the depicted applying tool 10 includes a plate 12, an application layer 14, and a handle 16. The plate 12 is formed of a rigid, yet lightweight material. Materials used to form the plate 12 may include SENTRA™ brand plastic or other plastics with similar properties. An application layer 14 secures to the plate 12. The application layer 14 serves to receive a compound, such as drywall mud to be applied to a surface. The unique construction disclosed below enables construction of a plate 12 and application layer 14 having a weight substantially equal to or less than eleven ounces per square foot of area of the lower surface of the application layer 14, though the tool 10 may also, of course, be constructed with a different weight. A handle 16 secures to the plate 12 to facilitate gripping by a user. In some embodiments, the handle 16 is substantially hollow and made of SENTRA™ brand plastic. In one embodiment, a handle 16 may have a weight of less than or substantially equal to five ounces. Referring to FIG. 1B, in some embodiments, a handle 16 is a pole 16 mounted to the plate 12 that facilitates applying compound to hard to reach areas.

Figure 2:
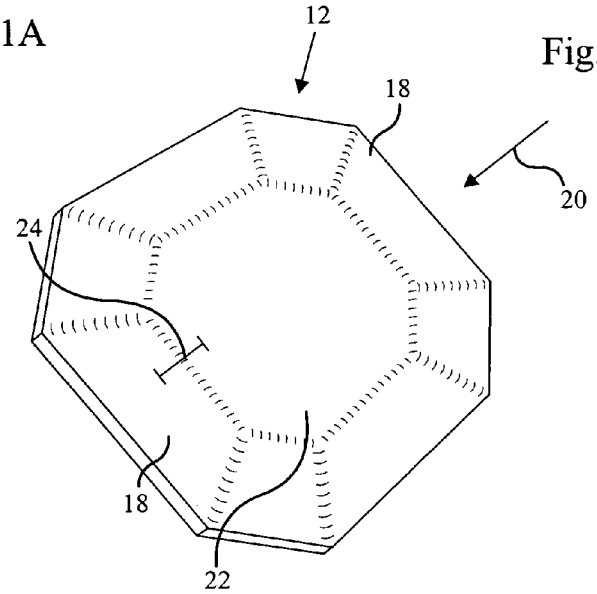
FIG. 2 is a lower perspective view of an applying tool, in accordance with the invention.

Referring to FIG. 2, a lower surface of an application layer may have a perimeter portion 18 and a flat central portion 22. The portions 18 and 22 may be contoured to facilitate use without leaving "edge marks," that is, markings in the applied compound made by distinct edges of an applying tool. Accordingly, in the depicted embodiment, a perimeter portion 18 slopes in an upward direction 20 from a flat central portion 22. The perimeter portion 18 may slope upwardly in either a straight or curved path. For example, the perimeter portion 18 may have an arcuate cross section. In order to further avoid edge marks, it may be beneficial that the transition region 24 between the perimeter portion 18 and the flat central portion 22 be rounded, rather than an abrupt edge between the flat central portion 22 and the perimeter portion 18 in order to discourage edge marks and apply drywall mud in a uniform manner to yield a uniform pattern.

Figure 3:
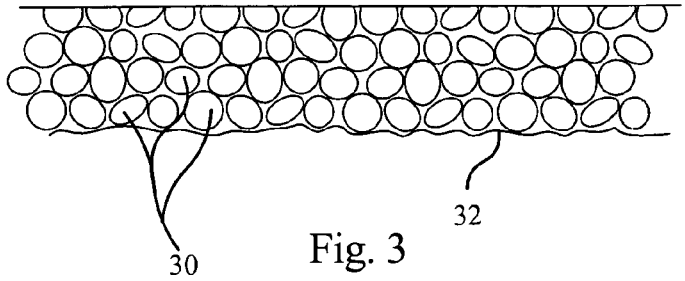
FIG. 3 is a cross-sectional view of closed-cell foam, in accordance with the invention.

Referring to FIG. 3, advantages in application of compounds may be obtained from the use of a compressible material to form the application layer 14. The compressibility of the foam facilitates consistent results from inaccurate use. For example, where a compound is distributed unevenly on the application layer 14, portions of the application layer near large amounts of compound will deform when the applying tool 10 is pressed to a surface, enabling the portions of the application layer 14 having less compound to contact the surface, notwithstanding the uneven distribution. Similarly, when the application layer 14 is not parallel to the surface of application, one edge of the application layer 14 may be subject to greater pressure than another. However, the compressibility of the application layer 14 will enable the edge of the application layer 14 subject to greater pressure to deform and compensate for the uneven application of pressure.

In some embodiments, using closed-cell foam to form the application layer 14 combines characteristics of lightness of weight and compressibility. A closed-cell foam typically consists of a plurality of air filled bubbles or cells 30. The lower surface 32 of the application layer therefore will consist of the walls of the cells 30. In order to provide a smooth, nonabsorbent surface, it may be desirable that the outer walls of the cells 30 remain unbroken. Broken cells 30 tend to collect drywall compound and are difficult to clean. Accordingly, it may be undesirable to machine the lower surface 32 of the application layer 14. In addition, closed-cell foam is typically available in broad sheets. Therefore, it may decrease manufacturing costs to have an application layer 14 having substantially uniform thickness such that standard sheets of foam may be used without modification in thickness.

Figure 4:
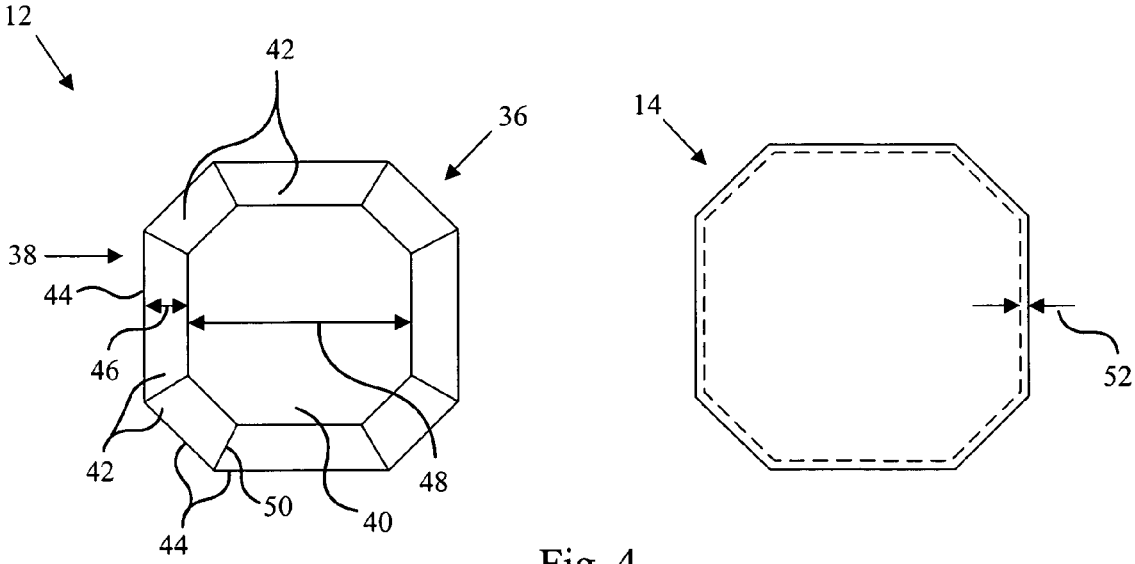
FIG. 4 is a bottom view of a top plate and an application layer, in accordance with the invention.

Referring to FIG. 4, a lower surface of a plate 12 may be formed to shape the application layer 14 when the application layer 14 is secured thereto. Accordingly, the lower surface 36 of the plate 12 may have a sloped portion 38 near the perimeter thereof. The sloped portion 38 typically slopes upwardly from a central portion 40. The central portion 40 is typically substantially flat. The sloped portion 38 may be formed as bevels 42 formed near a plurality of the edges 44 of the plate 12. The bevels 42 are typically milled or otherwise machined into the plate 12, or the plate 12 may be molded, stamped, or otherwise originally formed with bevels 42. In some embodiments, the sloped portion 38 may be formed by permanently bending the plate 12 upward near the edges, or by forming the plate 12 to be bent upward near the edges 44. In yet another alternative, the sloped portion 38 may be a stepped portion 38 formed by making the plate 12 with two separate plates, with one plate being larger than another. Thus a stepped portion 38 is formed by the portion of the larger plate extending beyond the larger plate.

The sloped portion 38 may extend into the plate 12 a distance 46 from the outer edges 44. The distance 46 is chosen to significantly reduce edge marks and encourage uniform application of compound when applying compound while still providing a substantial central portion 22 for receiving drywall compound. The combined central portion 22 and sloped portion 38 may also enable the applying tool 10 to be used to "touch up" non-uniform areas.

A distance 46 may be chosen to provide a sufficiently large sloped portion 38 such that the applying tool 10 may be held at an angle and the sloped portion 38 used as a small applying surface along the edges of walls and ceilings. In some embodiments, the distance 46 will be comparable in size to the breadth 48 of the central portion 40. In the illustrated embodiment, given by way of example, the distance 46 is approximately 1.25 inches, or approximately 15 percent of the breadth 48.

A plate 12 may be formed as a square, rectangle, circle, or other shape. It will be noted that an applying tool 10, regardless of shape, may be made in various sizes, for example embodiments having a plate 12 having a greatest width of eleven, fifteen, and eighteen inches are contemplated. In the illustrated embodiment, the perimeter of the plate 12 is shaped as an octagon. In some embodiments, the plate 12 is an octagon having edges of unequal lengths formed by truncating the corners of a square or rectangle. Forming a plate 12 having eight, rather than four, edges 44 may enable the fitting of an application layer 14 without substantial folds of material forming at the corners. At the line 50 where the bevels 42 of adjacent edges 44 meet, the folding of the application layer 12 to conform to the bevels 12 may cause a fold of extra material to be created. By increasing the number of edges 44, the extra material will be distributed over more corners and thus be more easily dealt with by the stretching and compressing of the application layer 12 to provide a substantially smooth surface that is upwardly extending around its entire perimeter.

The application layer 14 may be formed to have a substantially identical shape as the plate 12. In some embodiments, the application layer 14 also extends a distance 52 beyond the plate 12 when assembled with the plate 12. Extension of the application layer 14 further facilitates consistent application of drywall compounds. Due to the compressibility of the application layer 14, the portion extending beyond the plate 12 is free to flex and bend in response to pressure exerted thereon. Accordingly, the formation of sharply defined edge marks is discouraged, inasmuch as the edges of the application layer will not support forces likely to cause such edge marks.

Figure 5A:
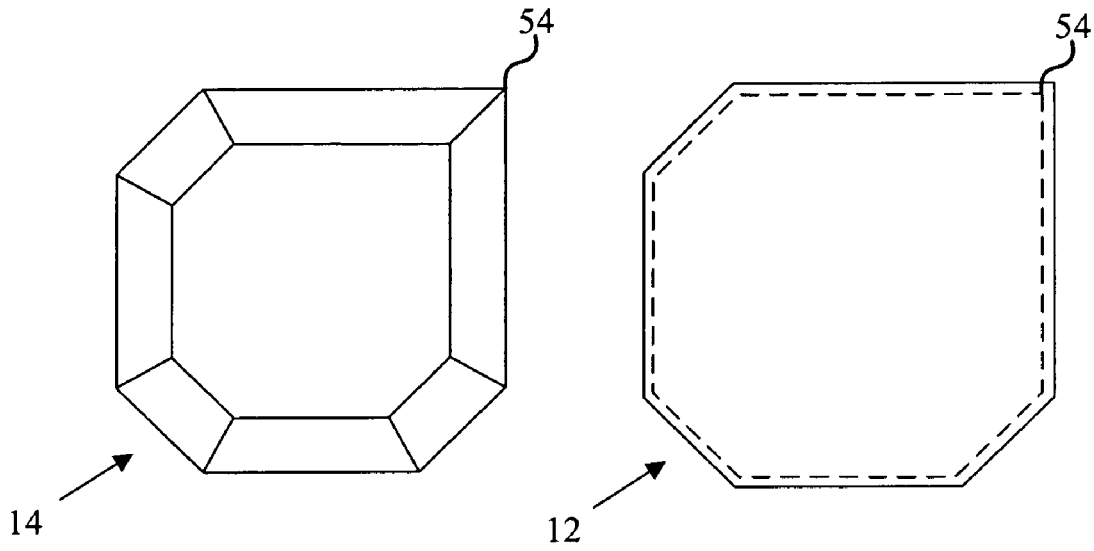
FIG. 5A is a bottom view of an alternative embodiment of a top plate and application layer, in accordance with the invention.
Figure 5B:
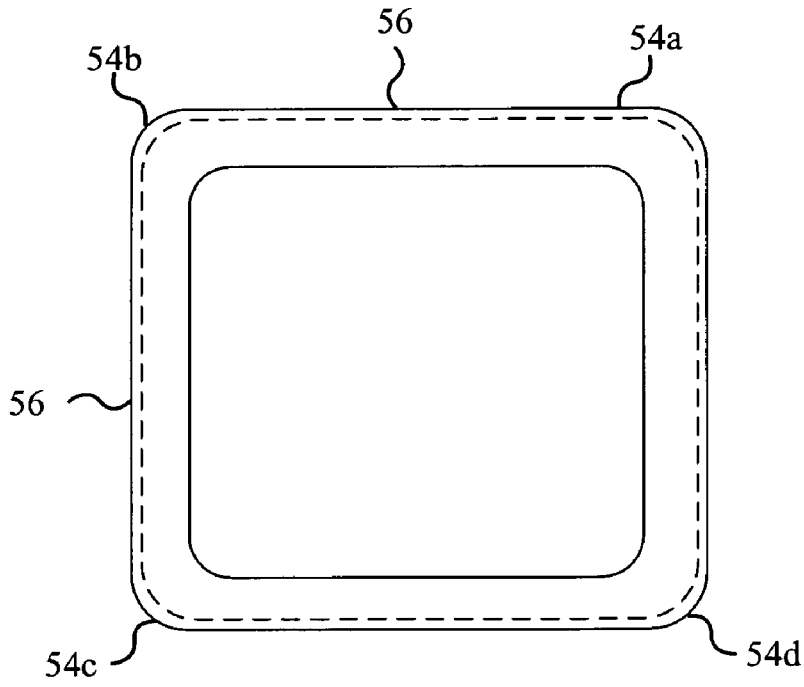
FIG. 5B is a bottom view of another alternative embodiment of a top plate and application layer, in accordance with the invention.

Referring to FIGS. 5A and 5B, various perimeter shapes for the plate 12 and application layer 14 may be used. For example, in the embodiment of 5A a corner 54 is left untruncated. In the illustrated embodiment, one corner of the plate 12 and application layer 14 is formed at a 90 degree angle, whereas all other corners are formed at 135 degree angles. Such a selection of corner angles provides one corner for use in applying compounds in corners, such as the corner of a ceiling where two walls meet, while still providing a convenient shape for applying compound in broad open areas.

In the embodiment of FIG. 5B, the corners 54*a*-54*d* of the plate 12 and application layer 14 are rounded, rather than truncated. The embodiment of FIG. 5B is useful for large applying tools 10 used to texture large areas. Experience has shown that the embodiment of FIG. 5B is appropriate for applying tools having sides 56 of from fifteen to eighteen inches.

Figure 6:
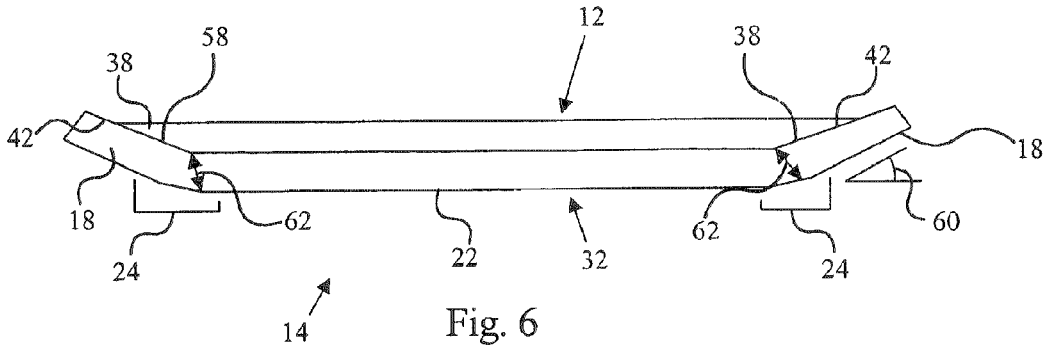
FIG. 6 is a side view of an applying tool in accordance with the invention.

Referring to FIG. 6, a plate 12 and application layer 14 may be assembled as illustrated. In the depicted embodiment, the application layer 14 secures to the upwardly sloping portion 38 to cause the perimeter portion 18 of the lower surface 32 to slope upwardly. In some embodiments, glue, or another adhesive or fastening means, may be applied at the boundary 58 between the plate 12 and the application layer 14.

The angle 60 of the upwardly sloping portion 38 may be chosen to discourage edge marks when applying compound while still providing an area for collecting compound and applying compound to a surface. In the illustrated embodiment, given by way of example, the angle 60 is approximately 15 degrees. In other embodiments, as an example, the angle 60 is in a range of between about 10 and 20 degrees. Forming an upwardly sloping portion 38 on the plate 12 and adhering the application layer 14 thereto may enable a rounded transition region 24 between the flat portion 22 and the perimeter portion 18. This mode of assembly enables a substantially flat bevel 42 to be translated into a curved feature on the application layer 14 having a substantial radius of curvature 62. Accordingly, the cost of manufacturing an otherwise complex feature is eliminated.

Figure 7A:
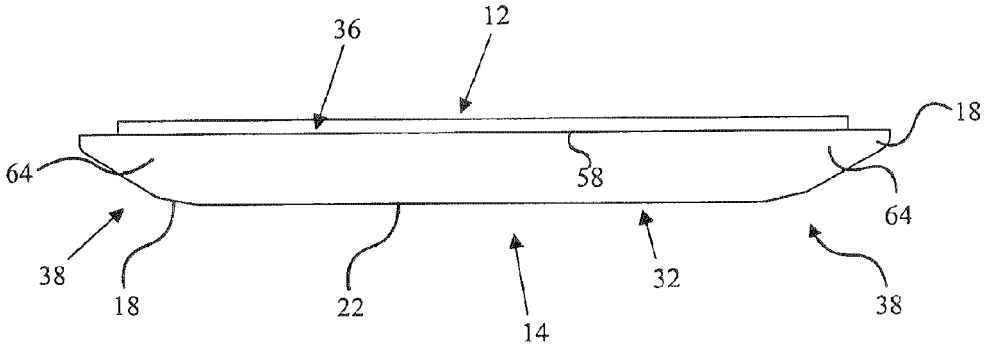
FIGS. 7A and 7B are side views of an alternative embodiments of an applying tool, in accordance with the invention.
Figure 7B:
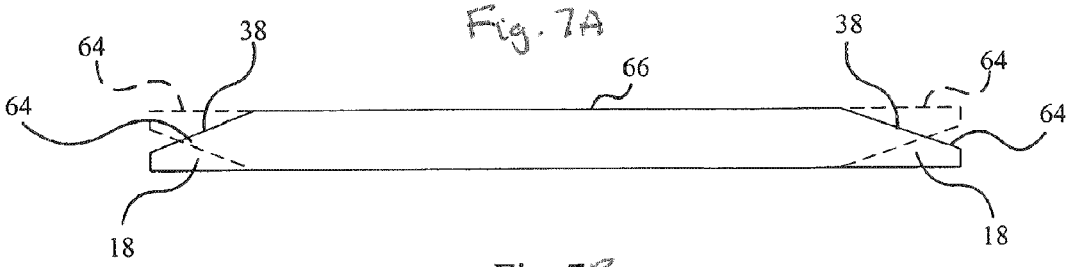

Referring to FIGS. 7A and 7B, various alternative structures may be used to accomplish an upwardly sloping perimeter. In some embodiments, the lower surface 36 of a plate 12 may be substantially flat whereas the sloped portion 38 is formed on the application layer 14. For example, an application layer 14 may be injected molded (see FIG. 7A) to have a sloped portion 38 formed therein. In some embodiments, a bevel 64 is formed on the upper surface 66 of the application layer (see FIG. 7B). When the application layer is secured to the plate 12 the perimeter portion 18 of the application layer 14 may be deformed to be flush with the plate 12 and secured thereto. In this manner, an upwardly sloping perimeter portion 18 will be formed in the lower surface 32 of the application layer 12.

In yet an alternative embodiment, a sloped portion 38 may be formed by forming a plate 12 of layers of material. For example a smaller plate may form the flat central portion 22 and may secure near to the center of the plate 12. The application layer 14 may then secure to the smaller plate and to portions of the plate 12 extending beyond the smaller plate, thereby creating an upwardly sloping perimeter portion 18. In such an embodiment, fasteners, such as screws, securing a handle 16 to the plate 12 may also secure the large plate to the smaller plate.

Figure 8:
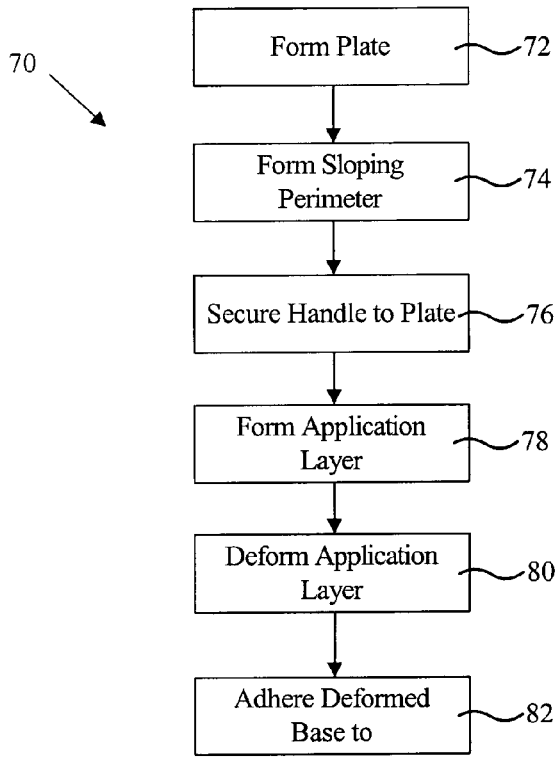
FIG. 8 is a process flow diagram of a method for forming an applying tool, in accordance with the invention.

Referring to FIG. 8, a method 70 for forming an applying tool 10 may include forming 72 a plate, forming 74 a sloping perimeter, securing 76 a handle to the plate forming 78 an application layer, deforming 80 the application layer, and adhering 82 the deformed application layer to the plate.

Forming 72 a plate typically includes forming a plate 12 having an appropriate thickness, perimeter shape, and sloped portion 38 at its perimeter, as described hereinabove. For example, a plate 12 having an octagonal perimeter may be formed 72. Forming 74 a sloping perimeter may include modifying the plate of step 72 to have a lower surface having an upwardly sloping perimeter. In some embodiments, steps 72 and 74 may be substantially simultaneous, with the plate being formed originally to have an upwardly sloping perimeter portion on its lower surface.

A method 70 may also include securing 76 a handle to the upper surface of the plate 12. It will be noted that various embodiments of handles may be used. For example, the illustrated handle 16 may be used. Alternatively, a pole 16 mounted to the upper surface of the plate 12 in a perpendicular relation thereto may be used. In some embodiments, a threaded socket or post may be secured to the plate 12 to receive a pole 16, or other handle 16, that may be secured 76 thereto.

Forming 78 an application layer may include forming an application layer 14, as described hereinabove, having a perimeter shape substantially similar to that of the plate 12. Deforming 80 the application layer 14 may include bending portions of the application layer 14 to conform to the contours of the lower surface of the plate 12. For example the perimeter 18 of the application layer 14 may be bent upwards to conform to the sloped portion 38 of the plate 12.

Adhering 82 the deformed application layer 14 to the plate 12 may include using fastening means to secure the application layer 14 to the plate 12 in a manner to maintain the application layer 14 in a deformed state. For example, glue may be applied to the upper surface of the application layer 14, the lower surface of the plate 12, or both. The process of deforming 80 the application layer 14 and adhering 82 the application layer 14 to the plate 12 may be substantially simultaneous. That is, adhesive may be applied to the application layer 14, the plate 12, or both, after which the application layer 14 may be deformed to conform to the sloped portion 38 of the plate 12 and pressed thereagainst.

Figure 9:
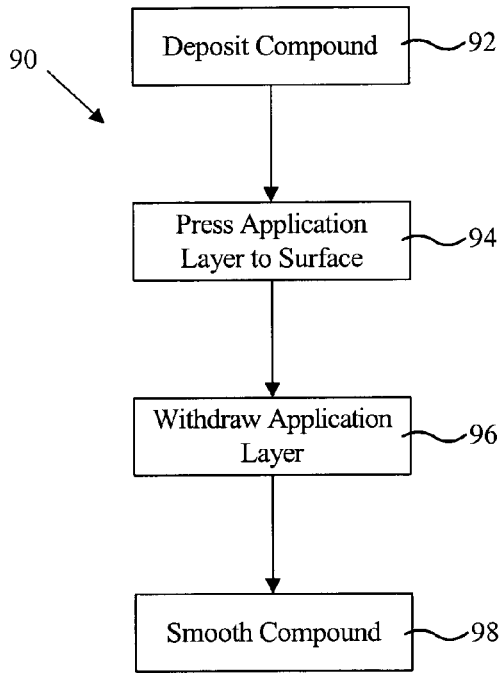
FIG. 9 is a process flow diagram of a method for using an applying tool, in accordance with the invention.

Referring to FIG. 9, an applying tool, such as an applying tool 10 may be used to perform an application process 90. An application process 90 may include depositing 92 drywall compound to the application layer 14, pressing 94 the application layer 14 to a building surface, withdrawing 96 the application layer 14, and smoothing 98 the compound. In one embodiment, the application process 90 may produce peaks and valleys of compound. The peaks are then leveled, leaving only the valleys to provide a visually appealing surface.

Figure 10A:
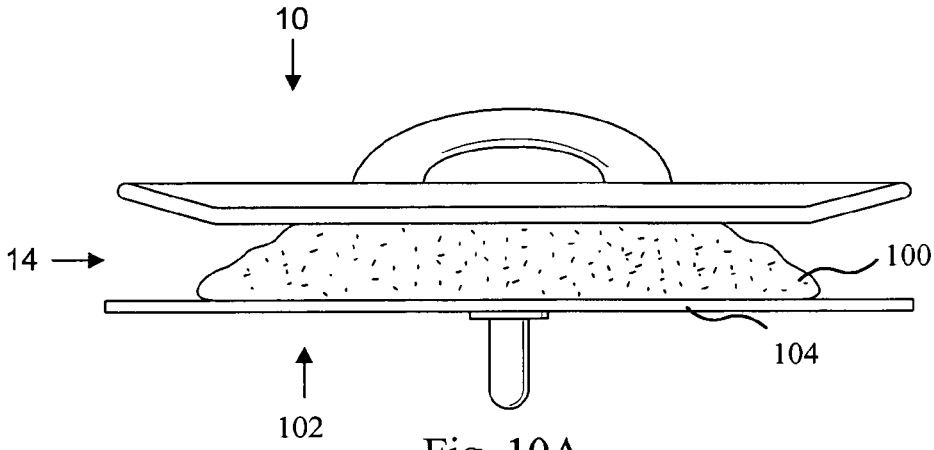
FIGS. 10A-10D are sequenced side views of an applying tool applying drywall compound in accordance with the invention.

Referring to FIG. 10A, depositing 92 drywall compound to the application layer 14 typically includes depositing an amount of drywall compound 100 on a flat surface 102 such as a hawk 104. The application layer 14 may then be pressed against the compound to deposit drywall compound thereon.

Figure 10B:
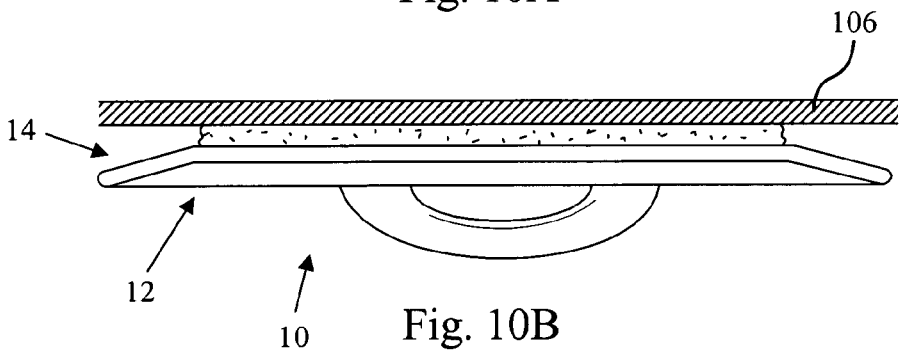
Figure 10C:
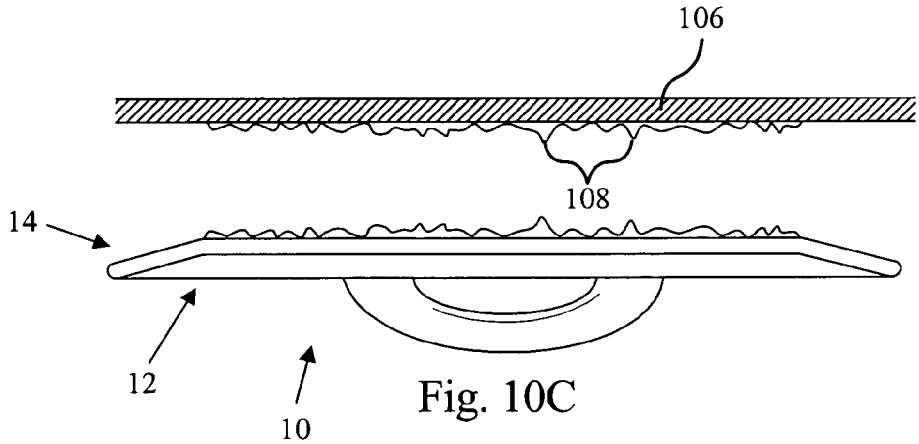
Figure 10D:
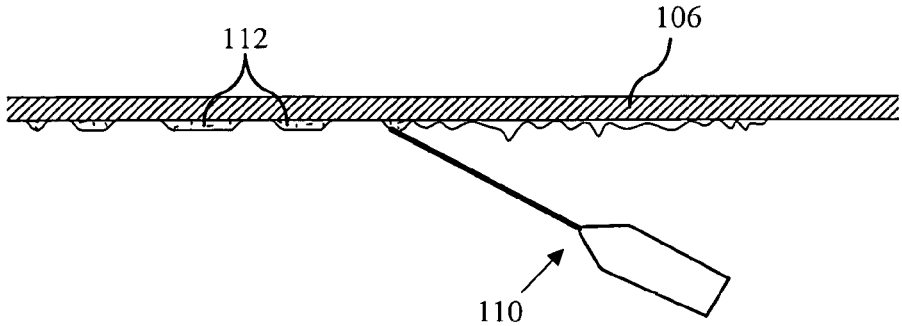

FIG. 10B illustrates the step of pressing 94 the application layer 14 to a building surface 106, such as a vertical sheet of drywall forming an interior wall or a horizontal sheet of drywall forming a ceiling, to deposit the compound 100. Referring to FIG. 10C, the application layer 14 may then be withdrawn 96, leaving peaks 108 of drywall compound on the surface 106. Referring to FIG. 10D, a trowel 110 may then be used to smooth 98 the compound 100, leveling the peaks 108 to leave a series of raised patterns 112 of drywall compound on the surface 106. Smoothing 98 the compound 100 may also include sanding the dried compound to further improve its appearance prior to painting.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for applying drywall compound to a surface, the apparatus comprising:

a plate comprising an upper surface and a bottom surface, the bottom surface of the plate having a flat central portion and an upwardly sloped perimeter, the upwardly sloped perimeter having a slope of less than 45 degrees relative to the flat central portion as measured progressing outward from the flat central portion of the bottom surface toward an outer edge of the upwardly sloped perimeter;

an application layer having a substantially uniform thickness and a rectangular cross-sectional shape previous to bonding; the application layer bonded to the upper plate to conform to the upwardly sloping perimeter to provide an application layer with a flat central region and a sloped perimeter; and a handle secured to the upper surface of the plate.

2. The apparatus of claim 1, wherein the sloped perimeter has an area that is equal to a substantial percentage of the area of the flat central region.

3. The apparatus of claim 1, wherein the application layer is substantially more compressible than the plate.

4. The apparatus of claim 1, wherein the application layer comprises closed-cell foam.

5. The apparatus of claim 1, wherein the upwardly sloping perimeter portion is formed as a bevel.

6. The apparatus of claim 1, wherein the sloped perimeter has a slope relative to the flat central region in the range of between about 10 and about 20 degrees as measured progressing outward from the flat central region toward an outer edge of the sloped perimeter.

7. The apparatus of claim 1, wherein the application layer extends beyond the upwardly sloped perimeter.

* * * * *